US005503572A

United States Patent [19]

White et al.

[11] Patent Number: 5,503,572

[45] Date of Patent: Apr. 2, 1996

[54] COMMUNICATIONS CONNECTORS

[75] Inventors: Rowland S. White, Lunenburg, Mass.; David E. Ivey, Whitchurch; Roy E. Mitchell, Basingstoke, both of England

[73] Assignee: Mod-Tap Corporation, Harvard, Mass.

[21] Appl. No.: 246,042

[22] Filed: May 17, 1994

[51] Int. Cl.[6] ..... H01R 21/22

[52] U.S. Cl. ..... 439/676; 439/76.1

[58] Field of Search ..... 439/76, 676, 395, 439/404, 405

[56] References Cited

U.S. PATENT DOCUMENTS

| | | | |
|---|---|---|---|
| 3,611,264 | 10/1971 | Ellis, Jr. | 339/99 R |
| 3,798,587 | 3/1974 | Ellis, Jr. et al. | 339/97 P |
| 4,171,857 | 10/1979 | Forberg et al. | 339/97 P |
| 4,676,576 | 6/1987 | Feldberg et al. | 439/404 |
| 4,725,249 | 2/1988 | Blackwood et al. | 439/535 |
| 4,738,629 | 4/1988 | Newman | 439/137 |
| 4,857,004 | 8/1989 | Poirier | 439/140 |
| 4,865,564 | 9/1989 | Denkmann et al. | 439/404 |
| 5,061,209 | 10/1991 | Bolick, Jr. et al. | 439/676 |
| 5,074,804 | 12/1991 | Pantland | 439/395 |
| 5,091,826 | 2/1992 | Arnett et al. | 361/408 |
| 5,096,442 | 3/1992 | Arnett et al. | 439/676 |
| 5,163,755 | 11/1992 | Shimomura et al. | 374/181 |
| 5,228,872 | 7/1993 | Liu | 439/607 |
| 5,251,092 | 10/1993 | Brady et al. | 361/56 |

FOREIGN PATENT DOCUMENTS

| | | |
|---|---|---|
| 0000434 | 5/1983 | European Pat. Off. . |
| 0080772 | 6/1983 | European Pat. Off. . |
| 0232521 | 8/1987 | European Pat. Off. . |
| 0311263 | 9/1988 | European Pat. Off. . |
| 2013423 | 12/1982 | United Kingdom . |
| 2146495 | 4/1985 | United Kingdom . |
| 2157096 | 10/1985 | United Kingdom . |
| 2167912 | 6/1986 | United Kingdom . |
| 2242080 | 9/1991 | United Kingdom . |
| WO92/22941 | 12/1992 | WIPO . |

OTHER PUBLICATIONS

*Panduit Perm–Net Universal Pan Jack,* brochure.
*Nevada Western O.M.N.I. Connector IDC Jack* brochure.
*Leviton Telecom Catagory 5 Compliant Jack* advertisement.
*AMP 110 Connect Modular Jacks* brochure.
*ATT Category 5 Keystone Jacks* brochure.
*M11BH and M11BH1 Modular 8–Pos/8–Cond IDC Termination C&I Outlets* brochure.
*Northern Telecom Unshielded Twisted Pair (UTP) Module ONE4P–Type* brochure.

*Primary Examiner*—Neil Abrams
*Attorney, Agent, or Firm*—Wolf, Greenfield & Sacks

[57] ABSTRACT

A communications connector sub-assembly comprises a body (10) defining a plurality of parallel grooves (37) each receiving a jack contact (30). The body includes one or more insulation displacement connectors (14, 16) which have insulation displacement contacts (12) anchored therein. The insulation displacement contacts are connected to the jack contacts through a printed circuit board (24). The anchoring of the insulation displacement contacts in the body secures the PCB to the body to give a complete sub-assembly. Side walls (44) are provided to surround and protect free ends (36) of the jack contacts from mechanical damage.

8 Claims, 3 Drawing Sheets

COMMUNICATIONS CONNECTORS

FIELD OF THE INVENTION

This invention relates to communications connectors and in particular to connectors suitable for use in voice and data communications systems.

BACKGROUND TO THE INVENTION

In the communications wiring of a building it is necessary to have socket connectors which may easily be connected to fixed building wiring, and into which devices (such as computers) may easily be plugged.

Many different ways of achieving this have been devised. In the case of the telephone socket used by British Telecom PLC of London, England, for example, the socket connector is attached to a printed circuit board, and insulation displacement connectors (IDCs) are mounted on the circuit board to enable the wires to be connected. This product is not complete in itself, and cannot be used except if permanently attached to a wallplate, and is unsuitable for other applications.

In designs produced by AT & T Corporation of New Jersey, USA and Panduit Corporation of Tinley Park, Ill., USA and Krone GmbH of Berlin, Germany, "lead frame" technology is used to manufacture a contact for the socket connection, with an integral insulation displacement contact being produced at the other extremity of this contact. These socket contacts are arranged to extend from the socket to a cavity where they connect directly to the insulation displacement contacts. They can be connected to each other either by virtue of being produced from the same piece of metal (Panduit & AT & T), or by welding two separate contacts together to simplify production of tile stamped parts (Krone). Due to the nature of their manufacturing process, they are only generally available in a single standard wiring configuration, as the process is not capable of producing different connection configurations without significant additional expense. In attempting to use lead-frame or similar technology to manufacture these connectors, illogical or undesirable connection sequences are necessary for the termination of the building wiring. Leadframe devices typically require eleven different parts. An example of the AT & T type connector is disclosed in U.S. Pat. No. 5,096,442 and U.S. Pat. No. 4,865,564. An example of the Krone type connector is disclosed in U.S. Pat. No. 5,074,804.

In designs produced by AMP Incorporated of Harrisburg, and subsequently adopted by many other manufacturers, a printed circuit board is used to connect an assembly of socket contacts to two or more assemblies of insulation displacement contacts. The printed-circuit assembly is then mounted into an overall plastic body which includes the necessary features to mate with the plug connector, and to fit onto a mounting plate. Such designs can easily be produced in a variety of different wiring sequences, but require many more assembly steps to make a finished product than the leadframe devices. The AMP designs typically use seven different parts to manufacture a connector capable of termination using industry standard wire termination tools.

The Prior Art devices described, as well as requiring a large number of parts, have the disadvantage that they can only be made available as complete usable assemblies in their own right, to be removably mounted to a variety of simple wallplates or patch panels, by the provision of suitable mounting features on the panels. They cannot be provided as partial assemblies for incorporation into devices already including the necessary jack body features, which is a very effective way to reduce product cost; nor can they be readily produced with different profiles to allow their fitment to devices with alternative mounting features. There is a proliferation of products around the world using different mounting features to clip the connector assemblies to wallplates or patch panels, and these are not generally compatible between manufacturers.

It is therefore an object of the present invention to provide a communications connector which can be provided as a partial assembly for incorporation into devices which already include the necessary jack body features.

It is a further Object of the invention to provide a communications connector which can be produced with different profiles to allow fitment to devices with different mounting features.

SUMMARY OF THE INVENTION

The present invention is defined by the independent claims to which reference should be made.

More particularly the invention provides a communications connector sub-assembly comprising: a body defining locations for receiving Jack contacts, locations for insulation displacement contacts and a location for a printed circuit board; a set of insulation displacement contacts arranged in said insulation displacement contact locations on said body; a set of jack contacts, each jack contact being arranged in said jack contact receiving locations on said body; and a printed circuit board retained in said printed circuit board location on said body; wherein the set of jack contacts and the set of insulation displacement contacts are connected to the printed circuit board.

Embodiments of the invention have the advantage that an incomplete sub-assembly may be provided for incorporation into communication assemblies. This enables, for example, a front body to be added when needed although in the case of wall sockets not requiring a shutter, the front body and wallplane can all be one moulding. As the majority of telecommunications wall sockets are duplex outlets, a single front moulding can be used even where shuttered outlets are specified, this one moulding having two connector bodies incorporated. In the case of patch panels the connector front body can be moulded either as part of the panel, or integral to the retainer mechanism if the panel is made of metal.

A distributor can assemble the appropriate front body to the rear connector assembly for his customer's application, where for example a specific style of wallplate is preferred by the user.

Less parts are used in the sub-assembly embodying the invention than in prior art printed circuit assemblies (including the British Telecom Phone Socket design), due to the incorporation of the IDC connector and the jack socket contact assembly into a single moulding. (Only five different parts are needed to make a complete connector assembly). Moreover, contact shapes may be kept simple, and complex mechanical handling, plating or welding of the intricate shapes required for the prior art designs is eliminated. This overcomes in particular a disadvantage of the Krone system described in the aforementioned U.S. Pat. No. 5,074,804.

Connector sub-assemblies embodying the invention have the further advantage that various contact connection configurations are possible simply by using an alternative printed circuit board.

The sub-assembly can be fitted with "front ends" having alternative mounting features gives a degree of flexibility not possible with prior art designs.

BRIEF DESCRIPTION OF THE DRAWING

Embodiments of the invention will now be described, by way example, and with reference to the accompanying drawings in which.

DESCRIPTION OF BEST MODE

Figure 1:
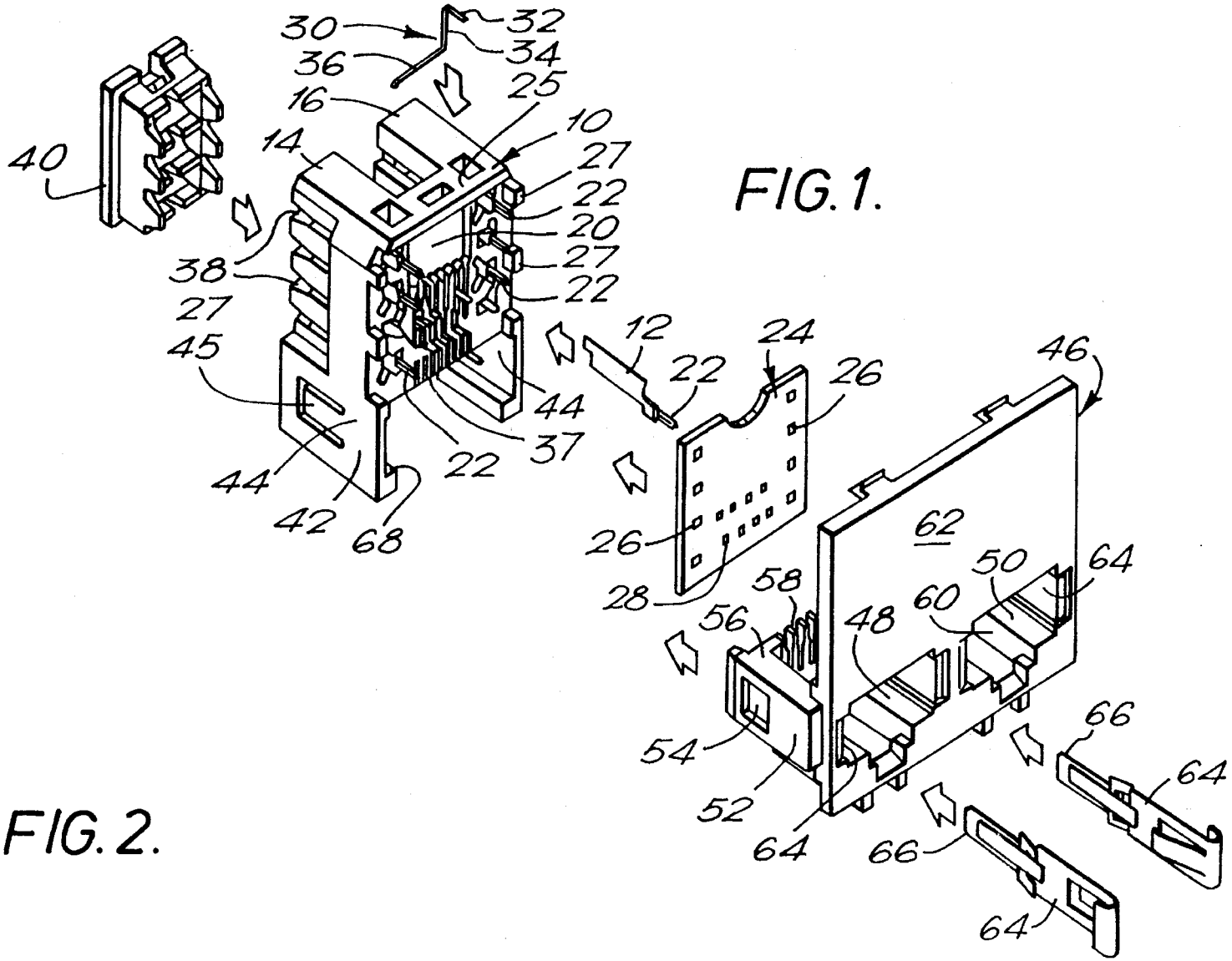
FIG. 1 is a schematic block diagram of a connector assembly including a sub-assembly embodying the invention.

The connector illustrated comprises a main body 10 which acts as a support member for a set of insulation displacement contacts 12. These contacts are received in parallel insulation displacement connector housings 14, 16 which form a part of the main body 10. As can be seen from the figure, the housings have slots 18 in the bottom face 20 through which the insulation displacement contacts can be inserted. These slots provide locations for receiving the insulation displacement contacts. In the embodiment illustrated each insulation displacement connector can receive four contacts although this number may be varied as required. The contact tails 22 only can be seen extending from the housings 14, 16 with one whole contact shown prior to insertion for ease of understanding. The contacts 12 are preferably retained in the IDC housings in the manner described in our co-pending application GB 9324274.1.

Figure 2:
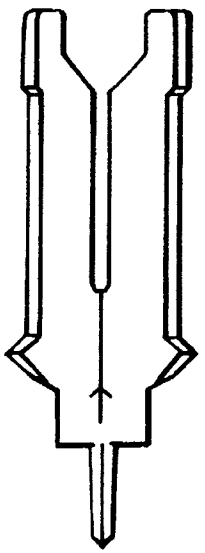
FIG. 2 is a view of a prepared insulation displacement contact.
Figure 3:
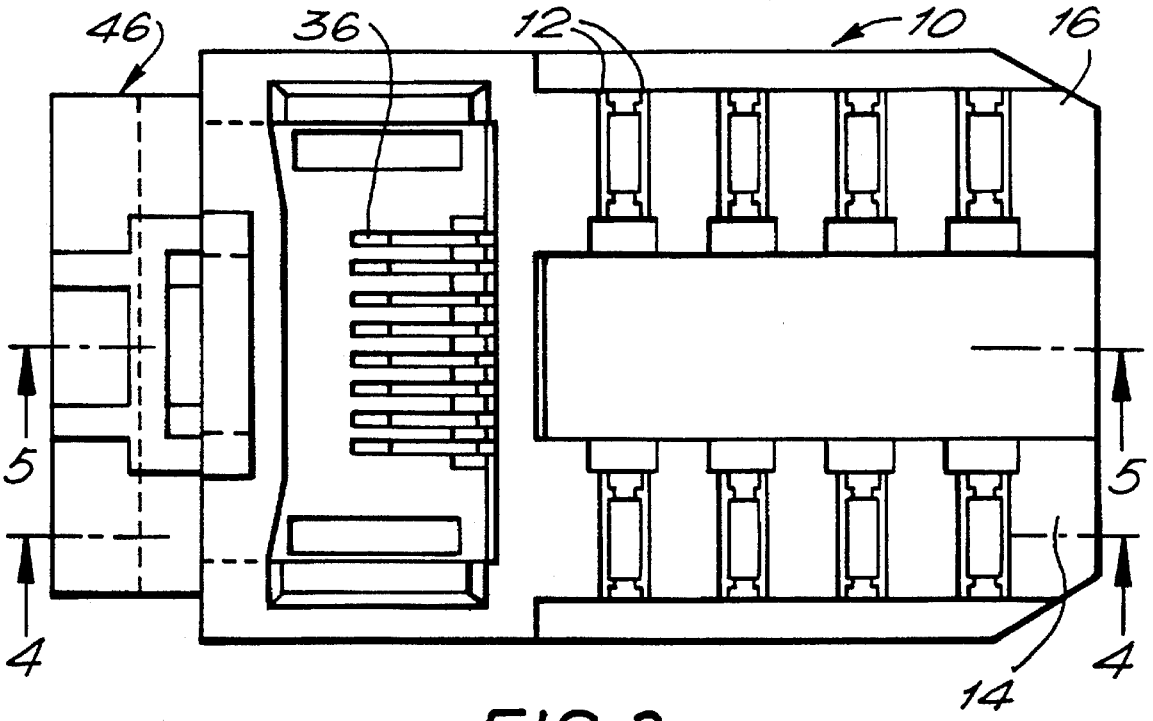
FIG. 3 is a rear view of the connector assembly shown in FIG. 1 when fully assembled.
Figure 4:
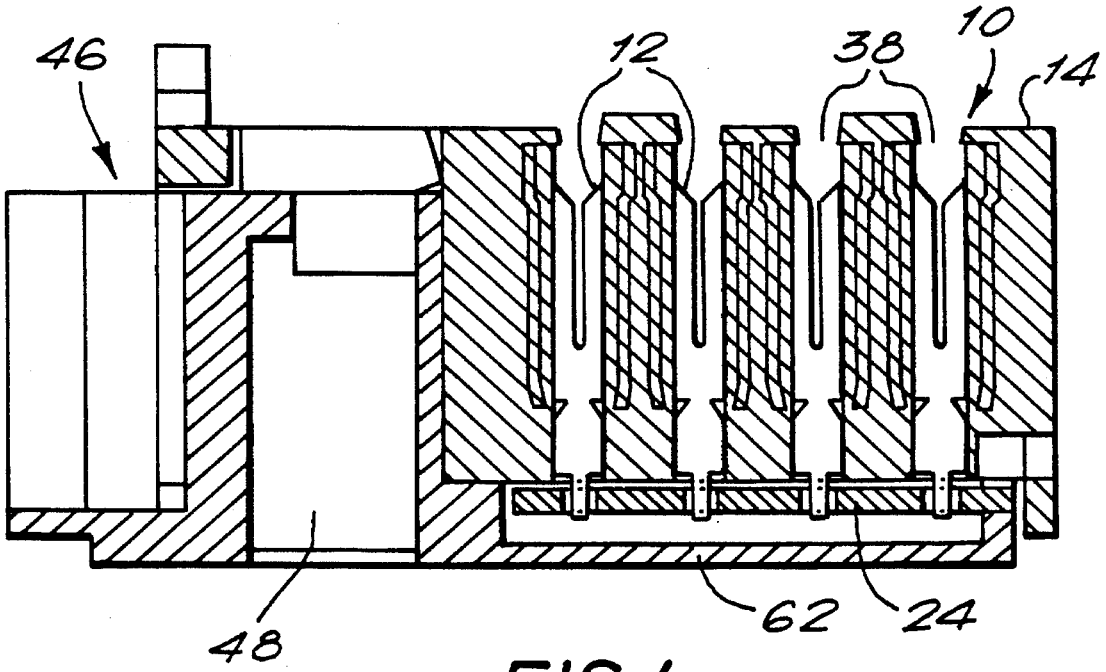
FIG. 4 is a sectional view taken along the line 4—4 in FIG. 3.
Figure 5:
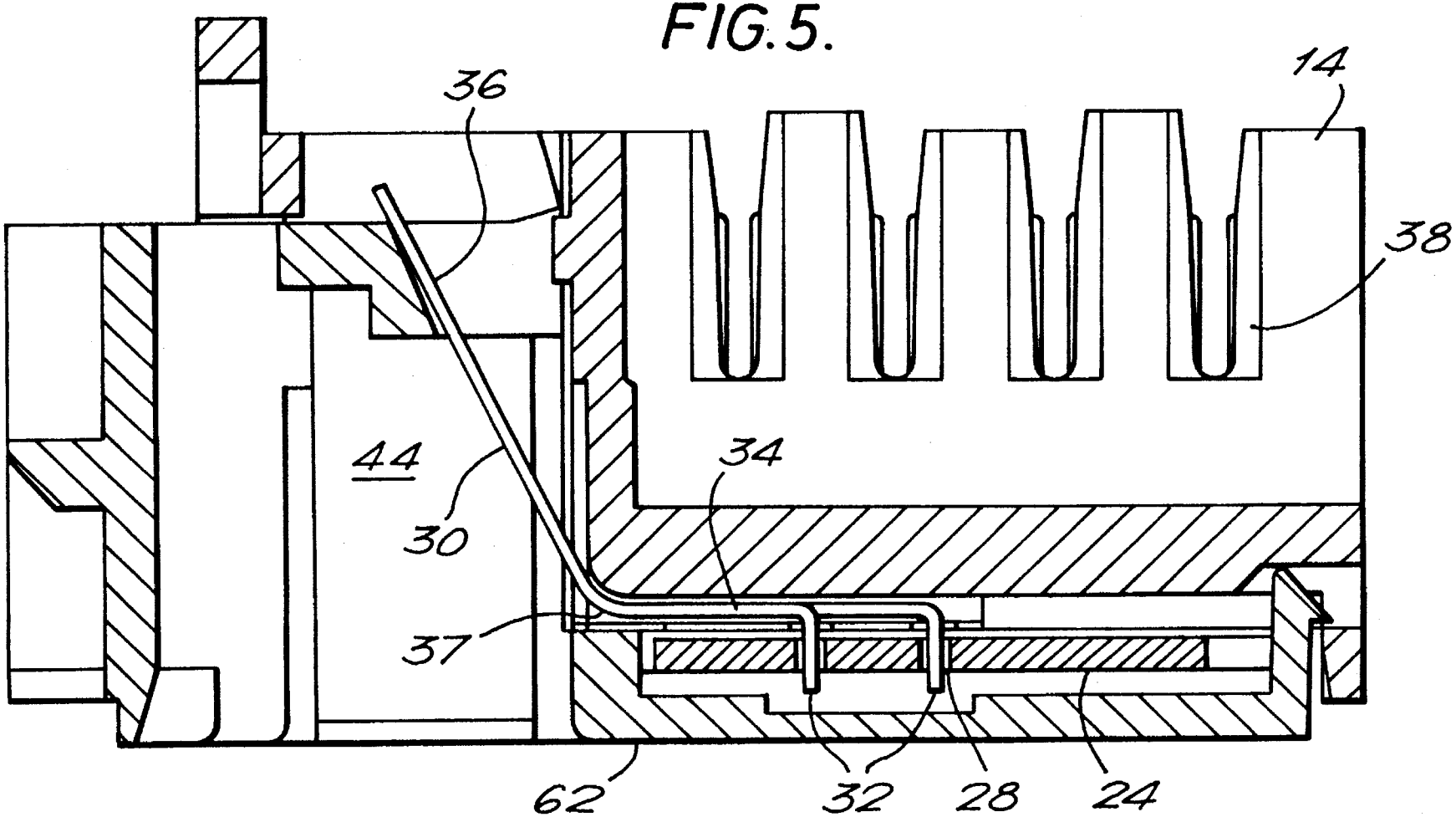
FIG. 5 is a sectional view taken along the line 5—5 in FIG. 3.

Other conventional methods may be used if space is not at a premium. FIG. 2 shows the insulation displacement contact which is disclosed in the aforementioned GB 9324274. For the purposes of this disclosure the salient point is the provision of one or more barb 15 on the sides of the contact by which the contacts are retained in the IDC housing. Other contact configurations retained in the same way may be used.

Preferably, although not essentially the contact shape and configuration is of the type disclosed in our International application WO/92/22941.

A printed circuit board (PCB) 24 is provided. The PCB has a first set of eight apertures 26 each of which receives a contact tail 22, and a second set of apertures 28 each of which receives a first end of one of a set of jack contacts. The jack contacts 30 correspond to each insulation displacement contact, eight in all in this embodiment. Each jack contact con, rises a wire having a first end 32 bent at right angles to a middle portion 34 and a second longer end 36 bent at approximately 45° in the opposite direction but in the same plane as the first end. The middle portions are received in a jack contact locating means formed as a series of parallel grooves 37 in the bottom face 20 of the main body and arranged such that the first ends are positioned to engage in the second set of apertures in the PCB 24 as described. Prior to fitting the PCB the Jack contacts are temporarily retained by mechanical interference in the grooves. The PCB is received in a receiving location on the underside of the body defined by the end wall 25 of the body and the bases of side walls 42. Laterally the receiving location is constrained by a set of tabs 27.

The main body also includes location sloes 38 which enable wires to be engaged into the insulation displacement connector (IDC) contacts 12. This may be by means of a stuffer cap 40 which is illustrated for convenience but does not form a part of the invention.

The main body also comprises an end section 42 comprising a pair of parallel walls 44 which provide a protective shield for the free ends 36 of the jack contacts during handling.

The walls 44 of the end section each have a resilient tooth 45 for snap engagement with a jack body.

The printed circuit board when in position and with all sixteen contacts received in their respective apertures is secured by soldering the tails of the contacts. Tracks on the circuit board provide the connects between individual jack contacts and IDC contacts so that any desired wiring configuration can be achieved by use of a suitably configured PCB.

Once the PCB has been soldered into position a sub-assembly is formed which is held together by the retention of the IDC contacts in the connector body in the manner described.

Thus, the sub-assembly can be handled or used at this stage in contradistinction to prior art connectors in which the contacts will fall out of the moulding or the free ends 36 of the jack contacts will be too vulnerable to mechanical damage to allow the sub-assembly to be stored or handled without a receptacle body assembled to the device.

In an alternative construction a further aperture is provided in the PCB 24 and a post is provided on the underside 20 of the main body 10. The PCB may then be heat staked or fastened by some other convenient means such as a snap bead to the main body. Alternatively, or in addition, the tabs 27 and the end wall 25 may be provided with snap teeth to retain the PCB which would dispense with the need for an extra post and aperture. In these arrangements it is not essential to use the method of securing the IDC contacts 12 in the housing 14 described in our aforementioned patent application GB 9324274.1. However, this is still preferred.

In the embodiment illustrated the sub-assembly comprising the main body 10, IDC contacts 12, PCB 24 and jack contacts 30 may be secured to a front body 46. The front body illustrated can receive two sub-assemblies one for each of two socket housings 48 and 50. The front body 46 has side walls 52 each of which carry a recess 54 which receives the corresponding tooth 45 on the walls 44 of the main body. The rear of the socket portions 56 of the front body carry a set of parallel grooves 58 which receive the free angled ends 36 of the jack contacts, presenting them for contact with a jack plug inserted through one of the apertures 60 on the front face 62 of the front body. In the embodiment shown, shield continuity contacts 64 may be inserted in channels 64 at the side of the socket housings. The tails 66 of these contacts, which are optional, extend through apertures (not shown) in the rear of the front body sockets.

To assist in assembly, the main body 10 includes a pair of guides 68 at the free ends of the side walls 44. The undersides of the side walls 52 of the front body slide along these guides until the teeth 45 engage in the recesses 54.

It is to be understood that the front body described is only one example of the type of mounting to which the sub-assembly comprising the main body, IDC contacts, PCB and jack contacts can be fitted.

The provision of the sub-assembly described has the advantage that incomplete connector sub-assembly may be incorporated into telecommunications assemblies.

We claim:

1. A communications connector sub-assembly for use with a front body having a jack socket, the subassembly comprising:

a body defining locations for receiving jack contacts, locations for receiving insulation displacement contacts, a location for receiving a printed circuit board and means defining a chamber for receiving the front body;

a set of insulation displacement contacts arranged in said insulation displacement contact locations on said body;

a set of jack contacts, each jack contact comprising a first end, a middle portion and a second end angled with respect to the middle portion, with the middle portion of each jack contact being arranged in said jack contact receiving locations on said body; and a printed circuit board retained in said printed circuit board location on said body;

wherein the insulation displacement contacts and the first ends of the jack contacts are connected to the same side of the printed circuit board, the middle portions of said jack contacts extend substantially parallel to said printed circuit board, and said second ends of said jack contacts extend into said chamber defined by said chamber defining means.

2. The communications connector sub-assembly of claim 1, wherein each of said set of insulation displacement contacts includes at least one barb for retaining the insulation displacement contact in said insulation displacement contact locations on said body, and wherein said printed circuit board is retained in said body through the connection of said set of insulation displacement contacts to said printed circuit board.

3. The communications connector sub-assembly of claim 1, wherein the chamber defining means further comprises means for protecting mechanically said jack contacts.

4. The communications connector sub-assembly of claim 3, wherein said protecting means comprises walls on said body shielding free ends of said set of jack contacts.

5. A communications connector assembly comprising at least one front body having a jack socket for receiving a plug and at least one sub-assembly according to claim 4, wherein said front body and the sub-assembly each include coacting elements for removably connecting the sub-assembly to the jacket socket.

6. The connector assembly of claim 5, wherein said at least one front body having a jack socket forms a part of a wall plate.

7. A communications connector assembly comprising:

a sub-assembly including (i) a first body defining locations for receiving jack contacts, locations for receiving insulation displacement contacts, a location for receiving a printed circuit board, and a pair of walls laterally adjacent the remainder of the first body and defining a chamber, (ii) a set of insulation displacement contacts arranged in the insulation displacement contact locations, (iii) a set of jack contacts each comprising a first end, a middle portion arranged in said jack contact receiving locations, and a second end angled with respect to said middle portion and extending into said chamber, and (iv) a printed circuit board retained in said printed circuit board location on said first body, the first ends of the jack sockets and the insulation displacement contacts being connected to the printed circuit board; and a second body comprising at least one jack socket;

wherein the first body and the second body further comprise means for removably engaging the at least one jack socket of said second body in said chamber laterally adjacent the remainder of said first body.

8. The communications connector assembly of claim 7, wherein each of said set of insulation displacement contacts includes at least one barb for retaining the insulation displacement contact in said insulation displacement contact locations on said body, and wherein said printed circuit board is retained in said body through the connection of said set of insulation displacement contacts to said printed circuit board.

* * * * *